US007806517B2

(12) United States Patent
Muraoka

(10) Patent No.: US 7,806,517 B2
(45) Date of Patent: Oct. 5, 2010

(54) LIQUID-JET RECORDING HEAD

(75) Inventor: Chiaki Muraoka, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/943,158

(22) Filed: Nov. 20, 2007

(65) Prior Publication Data

US 2008/0074467 A1 Mar. 27, 2008

Related U.S. Application Data

(60) Continuation of application No. 11/500,933, filed on Aug. 9, 2006, now Pat. No. 7,320,512, which is a division of application No. 10/842,471, filed on May 11, 2004, now Pat. No. 7,108,352.

(30) Foreign Application Priority Data

May 16, 2003 (JP) ..... 2003-138589

(51) Int. Cl.
*B41J 2/05* (2006.01)

(52) U.S. Cl. ..... 347/65; 347/40

(58) Field of Classification Search ..... 347/15, 347/40–43, 57, 65, 67–71, 9, 12, 20, 47, 347/51

See application file for complete search history.

(56) References Cited

U.S. PATENT DOCUMENTS

| | | | | |
|---|---|---|---|---|
| 5,208,605 | A | 5/1993 | Drake | |
| 5,519,423 | A * | 5/1996 | Moritz et al. | 347/65 |
| 5,717,448 | A * | 2/1998 | Inada | 347/43 |
| 6,137,502 | A | 10/2000 | Anderson et al. | |
| 6,959,979 | B2 * | 11/2005 | Goin et al. | 347/40 |

FOREIGN PATENT DOCUMENTS

| | | |
|---|---|---|
| JP | 5-201003 | 8/1993 |
| JP | 2003-508257 | 3/2003 |

* cited by examiner

*Primary Examiner*—Thinh H Nguyen
(74) *Attorney, Agent, or Firm*—Fitzpatrick, Cella, Harper & Scinto

(57) ABSTRACT

An ink-jet recording head has two kinds of nozzles discharging different volumes of ink-drops. Large nozzles discharging larger ink-drops and small nozzles discharging smaller ink-drops are disposed alternately along a side of a common liquid chamber. The opening area of the large nozzles is larger than that of the small nozzles. Flow paths communicating with the small nozzles are shorter than those communicating with the large nozzles. Since the smaller ink-drops are discharged at higher frequency than the larger ink-drops, printing speed in high-quality recording using mainly the smaller ink-drops is improved.

5 Claims, 6 Drawing Sheets

FIG. 7A
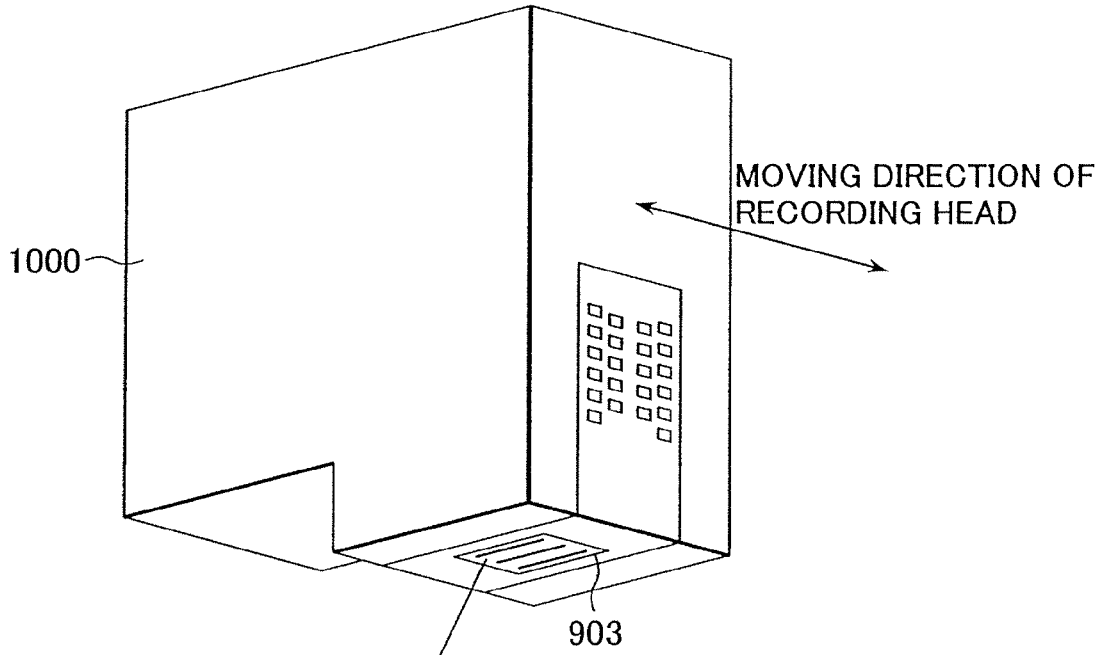
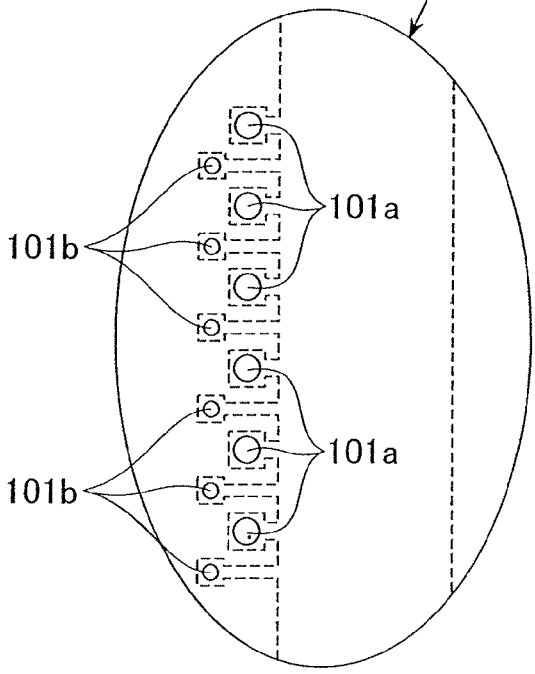
FIG. 7B

LIQUID-JET RECORDING HEAD

This is a continuation of application Ser. No. 11/500,933, filed Aug. 9, 2006, now U.S. Pat. No. 7,320,512, which is a division of application Ser. No. 10/842,471, filed May 11, 2004, now U.S. Pat. No. 7,108,352.

BACKGROUND OF THE INVENTION

1. Field of the Invention

The present invention relates to a liquid-jet recording head for recording on recording media by discharging liquid-drops from nozzles.

2. Description of the Related Art

In ink-jet printers that record images on recording media by discharging ink-drops, in order to achieve both high-quality printing and high-speed printing, it is useful to use a recording head with nozzles having different discharging amounts.

FIG. 7A is a perspective view of a recording head having such nozzles. This recording head 1000 is mounted on a so-called serial printer. The serial printer prints desired images by repeating recording on recording media row-by-row while conveying the recording media in the column direction. Therefore, this recording head 1000 is movable in the direction perpendicular to the direction of conveyance of the recording media (not shown). A discharging surface 903 with a plurality of nozzle columns is provided in the recording head 1000 so as to face the recording media. The nozzle columns are disposed perpendicular to the moving direction of the recording head. Each nozzle column consists of, for example, large nozzles 101*a* discharging ink-drops of 3 to 7 pl (picoliter) and small nozzles 101*b* discharging ink-drops of 1 to 2 pl (picoliter), disposed alternately and substantially parallel to the direction of conveyance of the recording media. In the case of printing at a high resolution, the small nozzles 101*b* discharging the smaller ink-drops are used. In the case of printing at a low resolution, the large nozzles 101*a* discharging the larger ink-drops are used. As examples of such a recording head, PCT Japanese Translation patent Publication No. 2003-508257 and Japanese Patent Laid-Open No. 5-201003 are given.

In the above known recording head, the smaller the volume of the smaller ink-drops, the higher the resolution of the recording. At the same time, the number of drops required for a certain print density increases because the recorded area per drop decreases. Therefore, in order to maintain a constant printing speed by discharging the smaller ink-drops, it is required to discharge them at higher frequency than the larger ink-drops.

Some of the known recording heads have increased discharging frequency of the smaller ink-drops as compared with discharging the larger ink-drops. However, there remains a huge gap between the printing speed for high-quality recording by using mainly the smaller ink-drops and that for high-speed recording by using mainly the larger ink-drops.

SUMMARY OF THE INVENTION

Considering the problems of the related arts described above, it is an object of the present invention to provide a liquid-jet recording head with nozzles whose discharging amounts are different, the recording head discharging the smaller liquid-drops at higher frequency than the larger liquid-drops in order to improve printing speed in high-quality recording using mainly the smaller ink-drops.

To attain this object, the present invention provides a liquid-jet recording head including a common liquid chamber supplied with liquid, a plurality of pressure chambers generating pressure applied to the liquid, a plurality of flow paths distributing the liquid from the common liquid chamber to the plurality of pressure chambers, and at least one group of first nozzles and second nozzles communicating with the plurality of pressure chambers in order to discharge the liquid, the group of nozzles being disposed along a side or a plurality of sides of the common liquid chamber and discharging amounts of the first nozzles and the second nozzles being different, wherein first nozzles in the group having a relatively small discharging amount have a discharging frequency higher than that of the second nozzles, and flow paths communicating with the first nozzles are shorter than those communicating with the second nozzles.

Since the flow paths communicating with the first nozzles are shorter than those communicating with the second nozzles, the fluid resistance there decreases in comparison. This improves the ability to supply liquid (refilling characteristics) to the nozzles discharging the smaller liquid-drops, and makes it possible to increase the discharging frequency when the smaller liquid-drops are discharged, and to move the liquid-jet recording head at higher speed. That is to say, in such a liquid-jet recording head, high-quality and high-speed recording is achieved.

Further objects, features and advantages of the present invention will become apparent from the following description of the preferred embodiments (with reference to the attached drawings).

BRIEF DESCRIPTION OF THE DRAWINGS

FIG. 7A is a perspective view schematically showing a head cartridge with a commonly used ink-jet recording head.

FIG. 7B is an enlarged view of a part of the recording head shown in FIG. 7A.

DESCRIPTION OF THE PREFERRED EMBODIMENTS

The embodiments of the present invention will now be described with reference to the drawings.

First Embodiment

Figure 3:
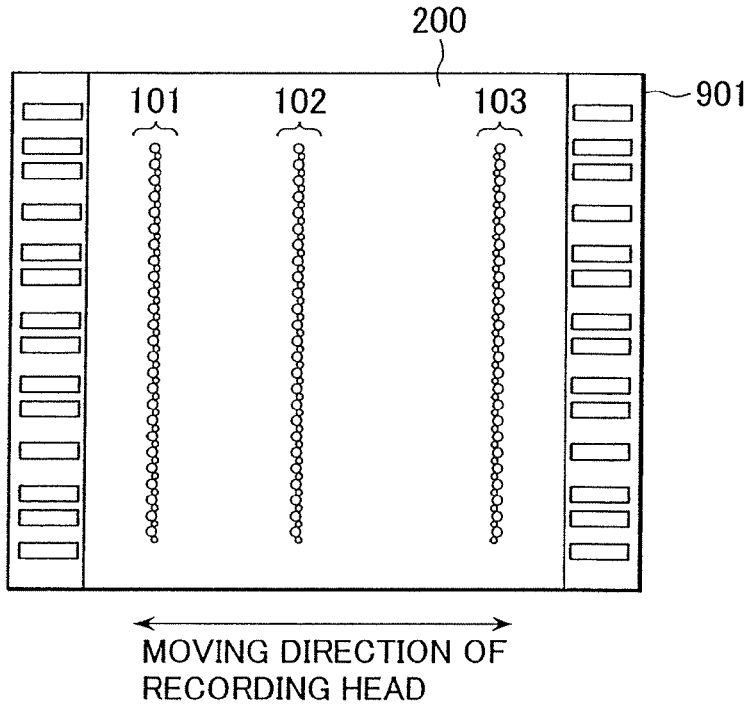
FIG. 3 is a schematic view of the recording head of the first embodiment of the present invention viewed from the direction facing the surface where nozzles are provided.

FIG. 3 is a schematic view of the ink-jet recording head of a first embodiment of the present invention viewed from the direction facing the surface where nozzles are provided. The recording head 901 shown in FIG. 3 is used for a serial printer, and it discharges two kinds of ink-drops with different volumes. Two kinds of nozzles discharging ink-drops with different volumes constitute three columns of nozzles 101 to 103 on the nozzle plate 200. The nozzle columns 101 to 103 may discharge different colors of ink. Each of the nozzle columns 101 to 103 may discharge a plurality of colors of ink. All nozzle columns may discharge the same color of ink. The number of nozzle columns is not limited to three, however.

This recording head 901 is provided on the discharging surface 903 of a head cartridge 1000 shown in FIG. 7A. The head cartridge 1000 is detachably attached to a carriage (holder). The carriage is included in an ink-jet printer (not shown) and moves in the direction of main scanning. The head cartridge 1000 is accommodated in a case (not shown) of the ink-jet printer. The moving direction of the recording head 901 in printing is the direction of the arrow in FIG. 7A, that is to say, perpendicular to the columns 101 to 103.

Figure 1:
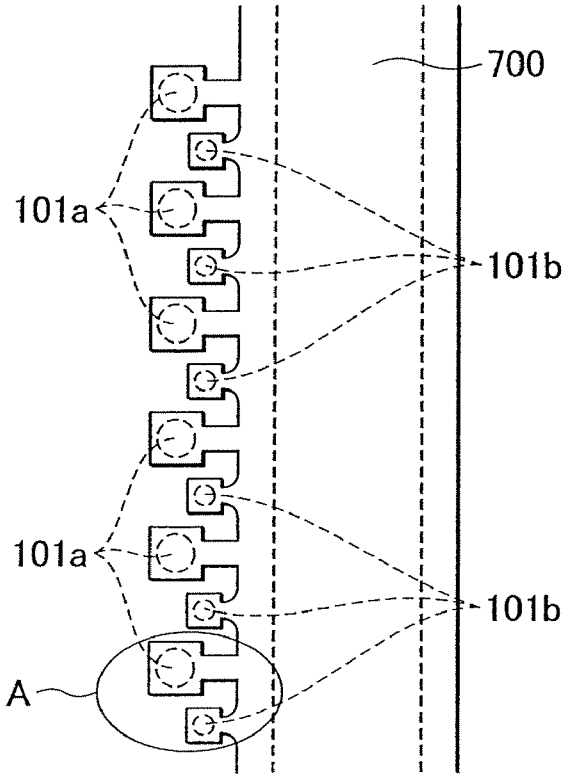
FIG. 1 schematically shows a nozzle column on the recording head of a first embodiment of the present invention with the nozzle plate removed.

FIG. 1 schematically shows a nozzle column on the recording head shown in FIG. 3 with the nozzle plate removed. For convenience of explanation, the parts normally invisible are shown with dotted lines in FIG. 1.

The large nozzles 101*a* are for discharging ink-drops of 3 to 7 pl (picoliter) volume (hereinafter referred to as large ink-drop discharging nozzles). The small nozzles 101*b* are for discharging ink-drops of 1 to 2 pl (picoliter) volume (hereinafter referred to as small ink-drop discharging nozzles). The two kinds of nozzles are arranged alternately along a side of a common liquid chamber 700. The opening area of the large nozzles 101*a* is larger than that of the small nozzles 101*b*.

Figure 2A:
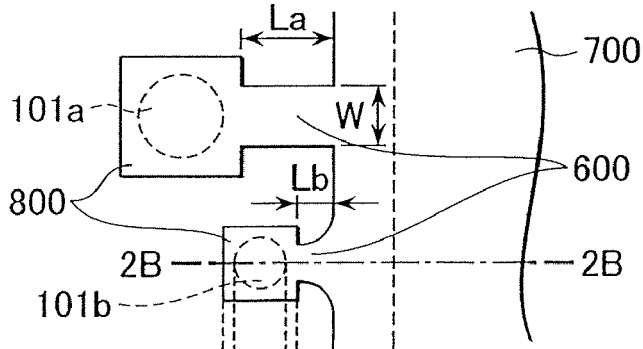
FIG. 2A is an enlarged view of part A in FIG. 1.
Figure 2B:
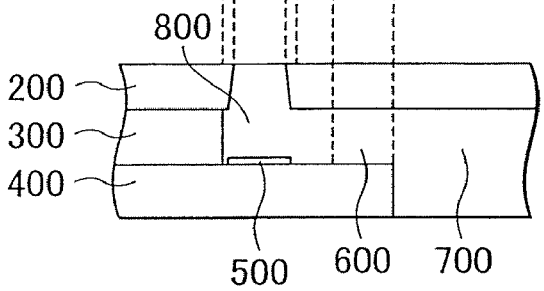
FIG. 2B is a schematic sectional view taken along line 2B-2B of FIG. 2A.

FIG. 2A is an enlarged view of part A in FIG. 1. FIG. 2B is a schematic sectional view taken along line 2B-2B of FIG. 2A. The nozzle plate 200 is joined to a substrate 400 via an adhesion layer 300. The substrate 400 has a long opening functioning as the common liquid chamber 700. The adhesion layer 300 is provided with pressure chambers 800 which are spaces facing heaters 500 on the substrate, and with flow paths 600 connecting the common liquid chamber 700 and the pressure chambers 800. The nozzle plate 200 is provided with nozzles (the large nozzles 101*a* and the small nozzles 101*b*) communicating with the pressure chambers 800 and discharging ink. The capacity of the pressure chambers 800 communicating with the large nozzles 101*a* is greater than that of the pressure chambers 800 communicating with the small nozzles 101*b*.

The ink supplied from the ink storage tank (not shown) disposed behind the recording head 901 to the common liquid chamber 700 is led to the pressure chambers 800 through the flow paths 600. When the heaters 500 disposed in the pressure chambers 800 filled with ink generate heat by application of electric energy, the ink bubbles on the surface of the heaters 500, thereby increasing the pressure in the pressure chambers 800. By the pressure thus generated, the ink is discharged from the large nozzles 101*a* or the small nozzles 101*b* toward the recording medium (not shown).

In order to increase the discharging frequency in such a recording head, it is very important to improve the ability to supply the nozzles with ink (refilling characteristics). This is because the amount of ink to supply to the pressure chambers 800 increases as the discharging frequency of the nozzles increases. The ink fluidity in the flow paths 600 with the highest fluid resistance determines the ability to supply the pressure chambers 800 with ink.

In the recording head of the present invention, the length of the flow path of the small ink-drop discharging nozzles (small nozzles 101*b*) is shorter than that of the large ink-drop discharging nozzles (large nozzles 101*a*) (La>Lb, as shown in FIG. 2A). Therefore, the fluid resistance in the flow paths of the small ink-drop discharging nozzles is relatively low.

If it is desired to shorten the flow path length Lb corresponding to the small ink-drop discharging nozzles (small nozzles 101*b*) further, in order to achieve both superior ink-discharging characteristics and the ability to supply ink, the flow paths 600 may be shaped so as to achieve smooth flow. For example, as shown in FIG. 2A, the flow paths 600 may be tapered from the common liquid chamber 700 toward the pressure chambers 800 so as to have a smooth curved inner surface.

In order to prevent reduction of the ability to supply ink to the large ink-drop discharging nozzles (large nozzles 101*a*), the width W of the flow paths corresponding to the large ink-drop discharging nozzles (large nozzles 101*a*) may be wider than that of the small ink-drop discharging nozzles (small nozzles 101*b*).

Second Embodiment

A second embodiment of the present invention will now be described.

Figure 4:
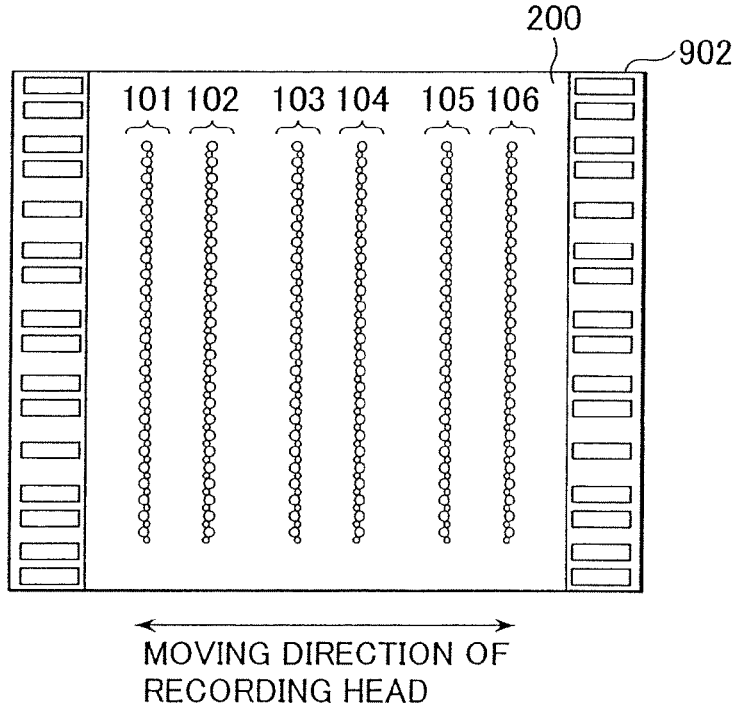
FIG. 4 is a schematic view of the recording head of a second embodiment of the present invention viewed from the direction facing the surface where nozzles are provided.

FIG. 4 is a schematic view of the recording head of the second embodiment of the present invention viewed from the direction facing the surface where nozzles are provided.

The recording head 902 shown in FIG. 4 is used for a serial printer, and it discharges two kinds of ink-drops with different volumes. Two kinds of nozzles discharging ink-drops with different volumes constitute six columns of nozzles 101 to 106 on a nozzle plate 200. The nozzle columns 101 to 106 may discharge different colors of ink. In this case, the nozzle columns 101 and 102, the nozzle columns 103 and 104, and the nozzle columns 105 and 106 form pairs and discharge the same color of ink. The number of nozzle columns is not limited to six, however.

This recording head 902 is provided on a discharging surface 903 of the head cartridge 1000 shown in FIG. 7A. The head cartridge 1000 is detachably attached to a carriage (holder). The carriage is included in an ink-jet printer (see FIG. 11) and moves in the direction of main scanning. The head cartridge 1000 is accommodated in a case (not shown) of the ink-jet printer. The moving direction of the recording head 902 during printing is the direction of the arrow in FIG. 7 FIG. 7A, that is to say, perpendicular to the columns 101 to 106.

Figure 5:
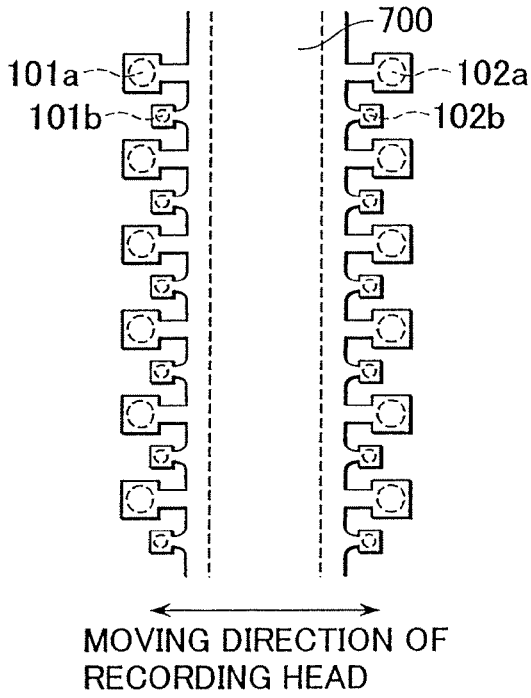
FIG. 5 schematically shows nozzle columns on the recording head shown in FIG. 4 with the nozzle plate removed.

FIG. 5 schematically shows nozzle columns 101 and 102 on the recording head 902 shown in FIG. 4 with the nozzle plate 200 removed. For convenience of explanation, the parts normally invisible are shown with dotted lines in FIG. 5.

Large nozzles (large ink-drop discharging nozzles) 101*a* are for discharging ink-drops of 3 to 7 pl (picoliter) volume. Small nozzles (small ink-drop discharging nozzles) 101*b* are for discharging ink-drops of 1 to 2 pl (picoliter) volume. The opening area of the large nozzles 101*a* is larger than that of the small nozzles 101*b*.

The difference between the first embodiment and the second embodiment is that the nozzle column 101 and the nozzle column 102 face each other across the common liquid chamber 700.

In each of the nozzle columns 101 and 102, the large nozzles 101*a* and the small nozzles 101*b* are arranged alternately. A pair of nozzles facing each other across the common liquid chamber 700 discharge the same amount of ink. That is to say, a large nozzle 101*a* in the nozzle column 101 is located directly across from a large nozzle 102*a* in the nozzle column 102, and a small nozzle 101*b* in the nozzle column 101 is located directly across from a small nozzle 102*b* in the nozzle column 102.

Thus, nozzles with same discharging amount are disposed in the same direction as the moving direction of the recording head. Therefore, mainly, the following advantages are achieved:

1. As compared with the case where a nozzle column is disposed on only one side of the common liquid chamber 700, recording can be performed at a frequency twice as high as the highest discharging frequency of the large nozzles 101*a* and the small nozzles 101*b*. That is to say, it is possible to increase the printing speed.

2. If a malfunction occurs in a nozzle (for example, if a nozzle becomes unable to discharge ink), the opposite nozzle replaces the malfunctioning nozzle and performs recording. Therefore, the deterioration of printing quality at a certain printing speed can be controlled.

Features other than this nozzle arrangement in each of the nozzle columns 101 and 102, and other features described above are the same as in the first embodiment.

Third Embodiment

A third embodiment of the present invention will now be described.

Figure 6:
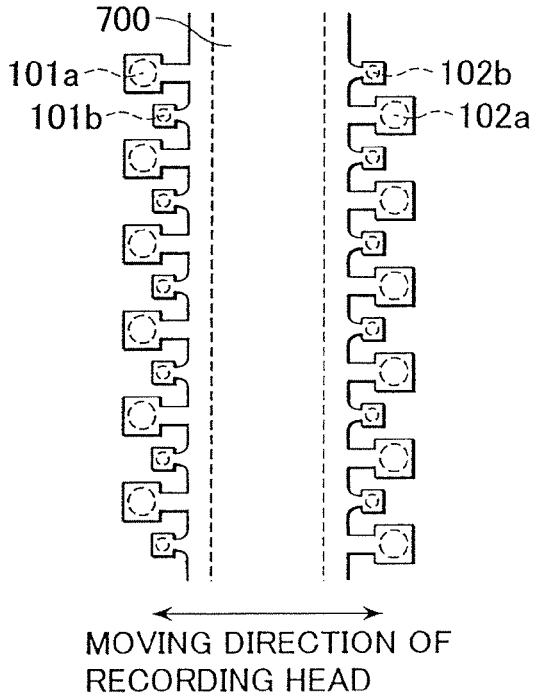
FIG. 6 shows another nozzle arrangement of adjacent nozzle columns of the recording head shown in FIG. 4.

FIG. 6 shows another nozzle arrangement in of the nozzle columns 101 and 102 of the ink-jet recording head 902 (described in detail in the second embodiment) shown in FIG. 4.

The difference between the second embodiment and the third embodiment is that every pair of nozzles facing each other across the common liquid chamber 700 discharge different amounts of ink. That is to say, a large nozzle (large ink-drop discharging nozzle) 101*a* in the nozzle column 101 is located directly across from a small nozzle (small ink-drop discharging nozzle) 102*b* in the nozzle column 102, and a small nozzle (small ink-drop discharging nozzle) 101*b* in the nozzle column 101 is located directly across from a large nozzle (large ink-drop discharging nozzle) 102*a* in the nozzle column 102. In other words, the position between adjacent large nozzles 101*a* in the nozzle column 101 is directly across from a large nozzle 102*a* in the nozzle column 102, and the position between adjacent small nozzles 101*b* in the nozzle column 101 is directly across from a small nozzle 102*b* in the nozzle column 102.

Since the arrangement of the large ink-drop discharging nozzles and the small ink-drop discharging nozzles in the nozzle column 101 and in the nozzle column 102 are staggered, the resolution can be twice as high as the case of the nozzle column 101 or 102 alone. That is to say, printing at higher resolution can be achieved.

Other features are the same as in the second embodiment.

In the above embodiments, a nozzle column consists of two kinds of nozzles, that is to say, large ink-drop discharging nozzles and small ink-drop discharging nozzles; however, the present invention is not limited to this. A nozzle column may consist of two or more kinds of nozzles whose discharging amounts are different. In this case, the length of the flow paths communicating with the nozzles whose liquid discharging amount is smaller is preferably shorter than that of the flow paths communicating with other kinds(s) of nozzles.

Other Embodiments

Printing by the recording head of the present invention applicable to the above embodiments, and a recording device having the recording head of the present invention will now be described with reference to the drawings.

Figure 8A:
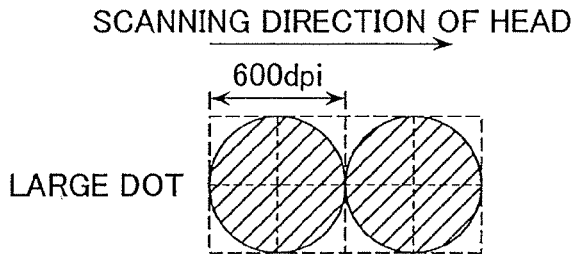
FIGS. 8A and 8B are schematic views for illustrating printing by the recording head of the present invention.
Figure 8B:
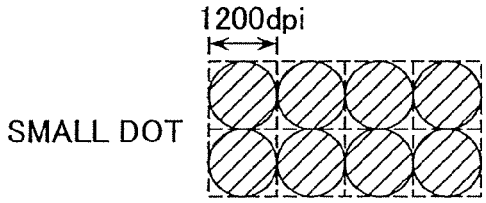

FIG. 8A schematically shows printing (large dots) by a large nozzle whose discharging amount is about 5 pl. FIG. 8B schematically shows printing (small dots) by a small nozzle whose discharging amount is about 1.2 pl. The grid of dotted lines represents a recording region divided according to the resolution. The small dots enable high resolution printing. At the same time, in order to achieve the same print density as the large dots, four times as many dots as the large dots are required. Therefore, if the small nozzle discharges ink at twice the frequency of the large nozzle, the small dot achieves the same recording density as the large dot with respect to the scanning direction. Therefore, the difference between the print speed of high-speed recording using large dots shown in FIG. 8A and that of high-quality recording using small dots shown in FIG. 8B can be reduced.

Figure 9:
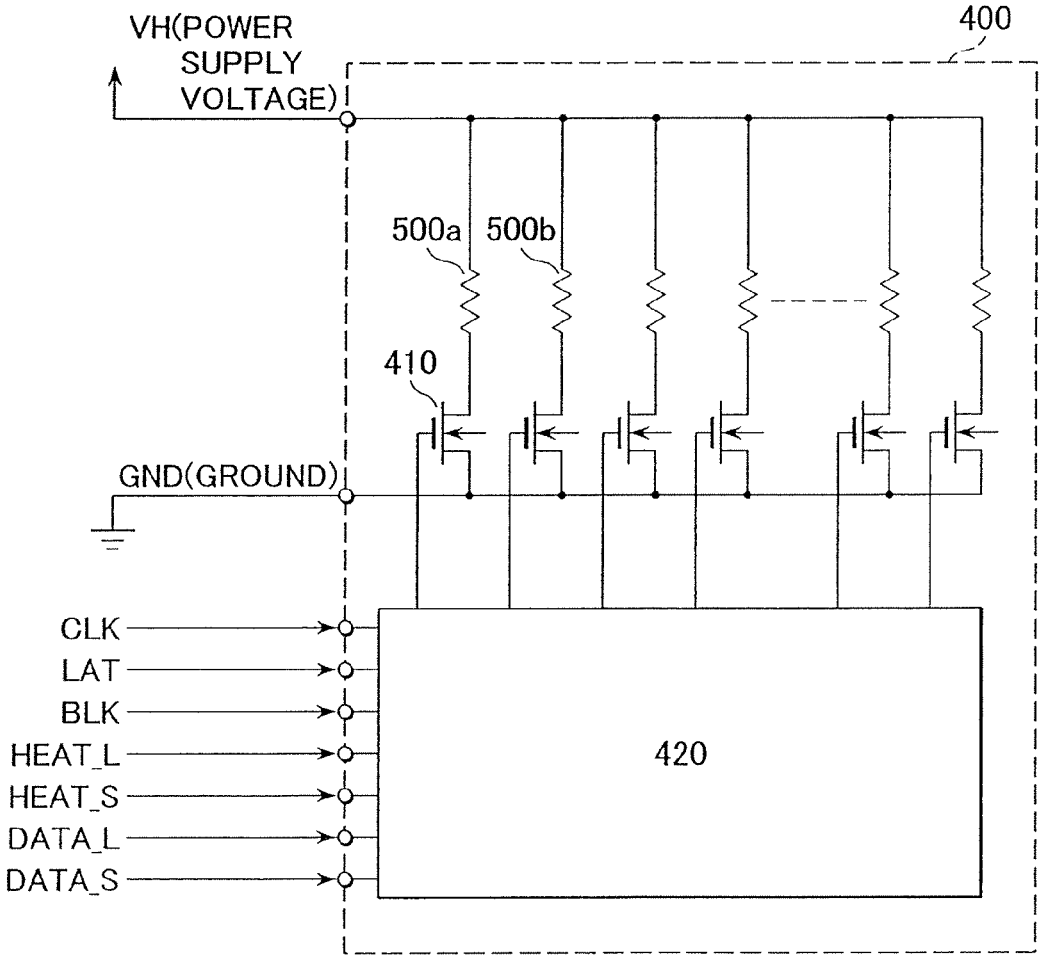
FIG. 9 is a schematic view showing a driving circuit for the recording head of the present invention.

FIG. 9 shows a driving circuit for a recording head of the present invention. A heater substrate 400 has heaters (large heaters) 500*a* for discharging large drops, other heaters (small heaters) 500*b* for discharging small drops, driving elements 410 for switching ON/OFF the heaters selectively, a driving signal generating circuit 420 inputting an ON/OFF signal into the driving elements, and terminals into which electrical signals are inputted from the printer body. When the driving elements 410 are switched ON, the heaters 500*a* and 500*b* are supplied with a power-supply voltage (VH) and heat the ink immediately, thereby causing film boiling and generation of ink-discharging pressure. The driving elements 410 are generally divided into several driving blocks in order to restrict the number of the heaters driven at the same time. The driving signal generating circuit 420 has logic circuits such as a shift register (not shown) for receiving image data serially and outputting it in parallel, a latching circuit (not shown) latching (storing) the data sent to the shift register, and a decoding circuit (not shown) decoding the block control signal received as binary data. The driving signal generating circuit 420 receives signals from the recording control unit of the printer body and generates ON/OFF signals for the driving elements 410.

Figure 10:
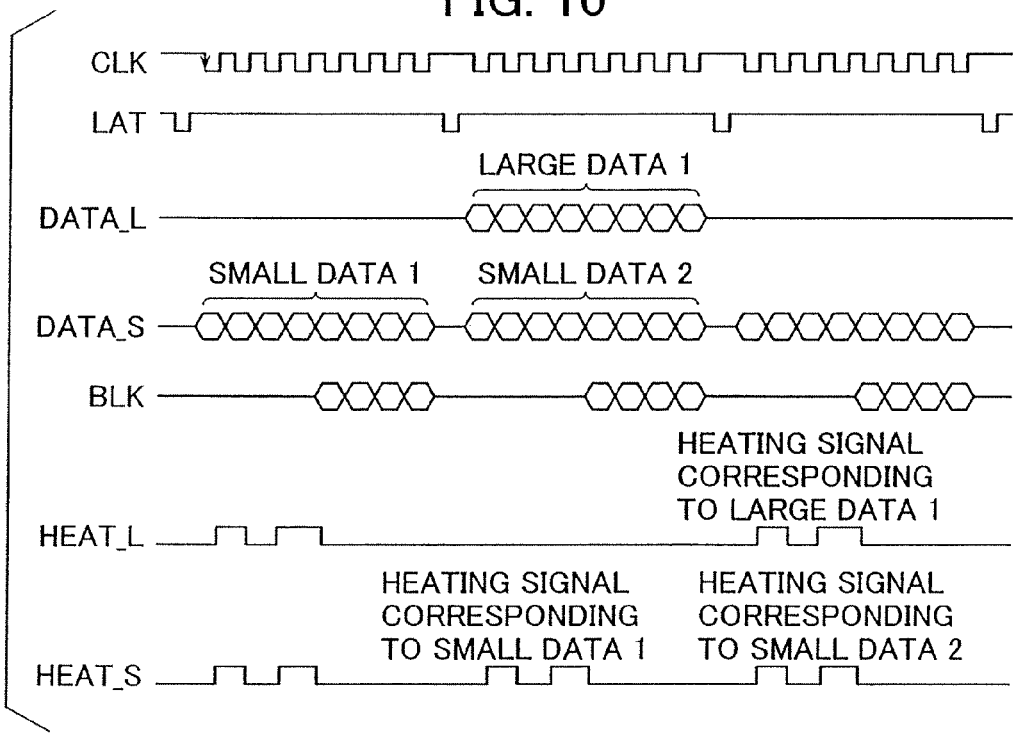
FIG. 10 is an illustration showing an example of input signals from the recording control unit of the recording device body into the recording head of the present invention.

FIG. 10 shows input signals from the recording control unit (not shown) of the recording device body of the present invention. DATA_L denotes recording data input into the large heaters (large data), DATA_S denotes recording data input into the small heaters (small data), and BLK denotes a block control signal indicating a driving block number. Those serial data are synchronized with the clock signal CLK and transmitted to the shift register in the driving signal generating circuit 420. Then the recording data are stored in the latching circuit by the latching signal LAT, and the block control signal is decoded. Predetermined heaters selected by a logical AND operation on the recording data and the block control signal are driven according to the input of a heating signal (HEAT_L or HEAT_S). HEAT_L denotes a signal for the large heaters, and HEAT_S denotes a signal for the small heaters. In order to make the discharging frequency of small dots twice as high as that of the large dots, as illustrated in FIG. 8, the input cycle of the HEAT_S signal is half as long as that of the HEAT_L signal. The input cycle of the recording data is adjusted to the cycle of the heating signal so that the small data is input twice while the large data is input once.

Although the recording data (DATA_L or DATA_S) and the block control signal BLK are input into the heater substrate 400 via separate signal lines, they may be on the same signal line and input together into the shift register in the driving signal generating circuit 420 of the heater substrate 400 to reduce the number of terminals.

Figure 11:
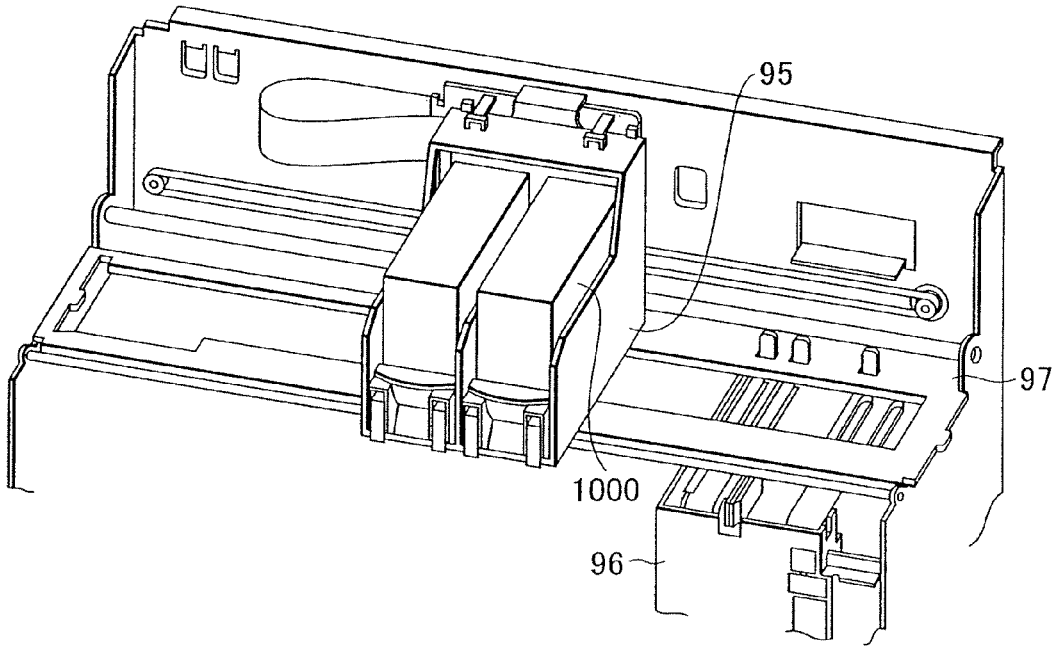
FIG. 11 is a schematic view showing an example of a recording device on which a recording head of the present invention can be mounted.

An example of a liquid-discharging recording device on which a recording head of the present invention can be mounted will be described with reference to FIG. 11. In the recording device shown in FIG. 11, reference numeral 95 denotes a carriage on which a head cartridge (recording head) 1000 can be mounted detachably, reference numeral 96 denotes a head recovery unit including a head cap for preventing ink from becoming dried out from a plurality of orifices and a suction pump for suctioning ink from the plurality of orifices in the event of malfunction of the head, and reference numeral 97 denotes a paper supplying surface on which a recording paper is conveyed as a recording medium.

The carriage 95 has a home position above the recovery unit 96. Printing starts by scanning to the left in the figure according to input signals from the recording control unit (not shown) provided for the recording device.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid-jet recording head comprising:

a plurality of first flow paths, each of the plurality of first flow paths having a first length and positioned to fluidly communicate with an ink storage tank, each of the plurality of first flow paths terminating in a first nozzle from which ink is ejected during at least one mode of printing, and each of the plurality of first flow paths being tapered; and a plurality of second flow paths, each of the plurality of second flow paths having a second length greater than the first length, and positioned to fluidly communicate with the ink storage tank, each of the plurality of second flow paths terminating in a second nozzle from which ink is ejected during at least one mode of printing, each second nozzle being larger than each first nozzle, wherein the first nozzles and the second nozzles are alternately arranged.

2. The liquid-jet recording head according to claim 1, further comprising:

a plurality of first pressure chambers, each first pressure chamber positioned in fluid communication with corresponding ones of the first flow paths and the first nozzles; and a plurality of second pressure chambers, each second pressure chamber positioned in fluid communication with corresponding ones of the second flow paths and the second nozzles.

3. The liquid-jet recording head according to claim 1, wherein each first nozzle is used to produce a smaller ink drop volume than that of each second nozzle.

4. The liquid-jet recording head according to claim 1, wherein each first nozzle produces higher resolution printing than each second nozzle.

5. The liquid-jet recording head according to claim 1, wherein each of the plurality of second flow paths is not tapered.

* * * * *